US006554669B1

(12) United States Patent
Motosko

(10) Patent No.: US 6,554,669 B1
(45) Date of Patent: Apr. 29, 2003

(54) INFLATABLE FLOTATION DEVICE

(76) Inventor: Stephen J. Motosko, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 10/023,492

(22) Filed: Dec. 18, 2001

(51) Int. Cl.[7] ..... B63C 9/15
(52) U.S. Cl. ..... 441/129; 441/108
(58) Field of Search ..... 441/88, 106, 108, 441/129; 472/129

(56) References Cited

U.S. PATENT DOCUMENTS 3,676,276 A 7/1972 Hirshen et al.
3,992,739 A 11/1976 Stevens et al.
4,472,225 A 9/1984 Bimpson
5,685,752 A 11/1997 Fulton, Jr.
5,779,512 A 7/1998 Rupert
6,106,349 A 8/2000 Motosko

*Primary Examiner*—Sherman Basinger
(74) *Attorney, Agent, or Firm*—Charles J. Prescott

(57) ABSTRACT

An elongated inflatable tubular device bendable about spaced apart folds in multiple directions about the longitudinal axis. Spaced apart bendable folds are formed across the tubular member by attaching only the central areas of opposite portions of the side walls. Air within the tubular member is thus free to flow through each fold to balance air pressure. The central attached portions are sized in length along the longitudinal axis such that the outer unattached portions of each fold inflate and expand sufficiently to resiliently resist bending and stiffen the device while still allowing useful flexing of the device. The ends of the device may be cooperatively shaped having a central aperture formed therethrough to pliably receive the other end of the device. One or more of the central areas may also be open to alternately receive one of the ends in the same manner.

11 Claims, 8 Drawing Sheets

INFLATABLE FLOTATION DEVICE

BACKGROUND OF THE INVENTION

1. Scope of Invention

This invention relates generally to inflatable tubes formed of flexible material such as plastic, polymer coated fabric material, vinyl and other materials which are air tight, and more particularly to a flotation device formed of such a tubular member having multiple folds spaced apart along the length of the flotation device to facilitate ease of bending compliance to supported body contours.

2. Prior Art

One flotation device that has become quite popular in swimming pools and other swimming areas is a "pool noodle" which is an elongated member formed of flexible Styrofoam and other closed cell foam material. These pool noodles are typically five to six feet in length having a diameter of approximately three to six inches and are quite enjoyable for swimming pool play and simply floating relaxation in water. However, although they are bendable from a relaxed straight configuration with some stiffness with respect to the foam construction material itself, these swimming pool play and flotation devices require some continuing effort to maintain them in a curved, behind the neck or under the torso in-use position which may be uncomfortable and may become tiring to the arms.

In U.S. Pat. No. 4,472,225, Bimpson teaches an inflatable tube such as a buoyancy tube for inflatable life rafts, particularly focusing on a method of imparting a permanent sealed bend into the tubular structure which is leak proof and economical to form without additional cutting or adding of material to effect a permanent bend in the tube.

Rupert, in U.S. Pat. No. 5,779,512, has disclosed a flotation device formed of smaller and larger concentrically attached buoyancy tubes. While adding buoyancy, this arrangement lends itself well to fitting the device over the head of the user around the neck area and yet accommodating the broader width of the user's shoulders.

A compressible and expandable flotation device shown in U.S. Pat. No. 5,685,752 invented by Holton, which is compressible and expandable in accordion fashion, includes internal structure, which allows the device to be self-inflating when the ends are moved apart and brought back together in repeated fashion. The water safety device invented by Stevens shown in U.S. Pat. No. 3,992,739 is formed of an elongated closed tubular member having a longitudinal handle strap along a length thereof for a victim to grasp while being pulled to shore by another person on shore or in a boat.

My previous invention disclosed in U.S. Pat. No. 6,106,349, overcame the stiffness or resistance to bending of the pool noodles by providing a plurality of folds formed transversely across the inflatable tubular member with the spaced apart folds oriented rotationally with respect to the longitudinal axis of the device in multiple directions so that the tubular member may be freely bent or wrapped around the body in complex arcuate fashion to better accommodate and support the various portions of the body beneath which the device is positioned. However, the folds in my earlier '349 patent were so easily bendable that a uniform contouring of the device was not achievable, the folds in that device acting almost as a free-bending hinge.

BRIEF SUMMARY OF THE INVENTION

This invention is directed to an elongated inflatable tubular device which is somewhat freely bendable, when inflated, in multiple directions about the longitudinal axis of the device. The device includes an elongated tubular member sealed at each end thereof to form a sealed inflatable air chamber. Spaced apart somewhat bendable folds are each formed generally transversely across said tubular member by attachment only the central areas of opposite portions or areas of the side wall of the tubular member. Air within said tubular member is thus free to flow past each fold to balance air pressure within the tubular member during inflation, deflation and bending thereof. The central attached portions are sized in length and width with respect to the width of the tubular member such that the outer unattached portions of each fold are also inflated to somewhat resiliently resist bending and somewhat stiffen the device while still allowing useful flexing of the device. The folds are preferably rotationally oriented differently one to another, when viewed along a longitudinal axis of the tubular member, thereby allowing the flotation device to be freely bendable in multiple directions about the longitudinal axis. In the preferred embodiment, the ends of the device are cooperatively shaped, each having a central aperture formed therethrough sized to pliably receive the other end of the device for releasable retention therebetween to reshape the device into a flexible ring.

It is therefore an object of this invention to provide an elongated tubular flotation device or inflatable tube having multiple spaced apart improved folds formed across the length of the device and angularly oriented with respect to the longitudinal axis of the tubular member in different directions to facilitate somewhat free bending movement about each of the folds to better accommodate the complex curvature of the supported body and torso.

It is another object of this invention to provide an inflatable flotation device which has substantially more compliance and comfort to body configuration and support thereof when swimming as compared to conventional, stiffer pool noodles.

It is still another object of this invention to provide an elongated air-filled tubular flotation device having multiple permanent spaced folds formed across the tubular member which allow for free passage of air within the device for ease of filling and deflation and pressure balancing between adjacent air chambers defined by adjacent folds, the outer unattached portions of each fold also expanding under inflation pressure to somewhat resiliently stiffen each fold.

In accordance with these and other objects which will become apparent hereinafter, the instant invention will now be described with reference to the accompanying drawings.

DETAILED DESCRIPTION OF THE INVENTION

Figure 1:
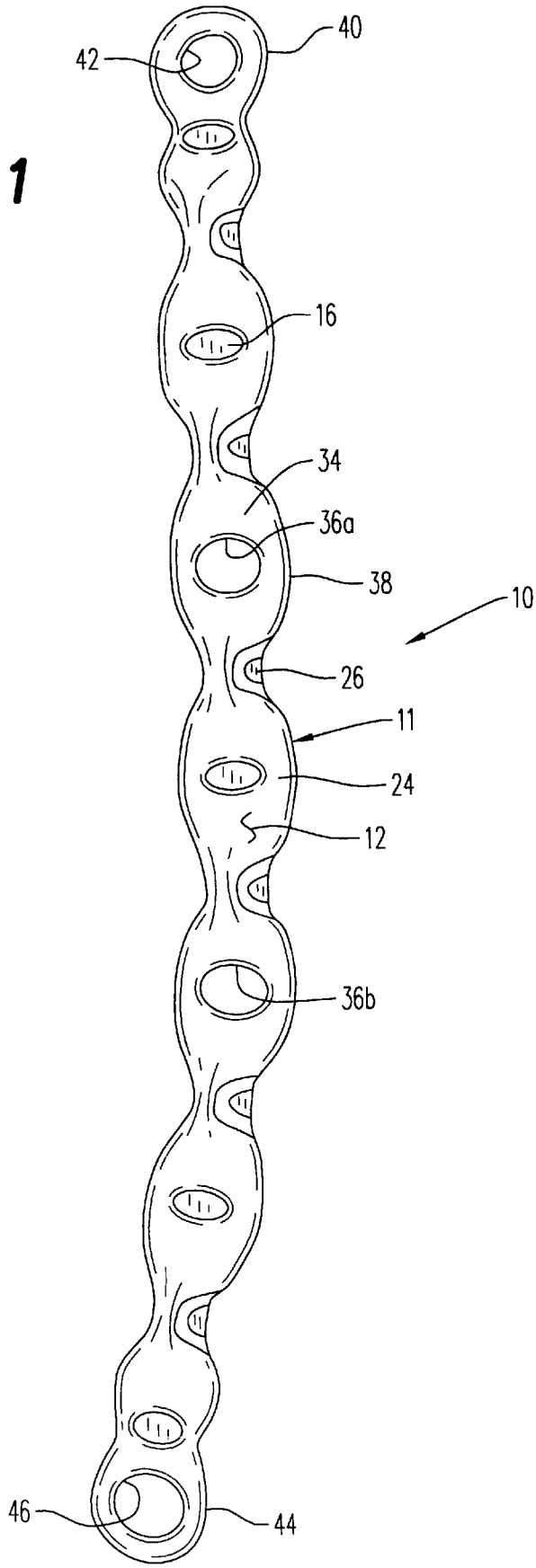
FIG. 1 is a side elevation view of the invention.

Referring now to the drawings, the invention is shown generally at numeral 10 and is formed of an elongated tubular member 11 made of flexible transparent, translucent or opaque air-tight material such as is used in other inflatable flotation devices for swimming pool play, water safety rescue and inflatable boats and dinghy's well known in the art. Each end 40 and 44 of the device 10, and longitudinal seam 22 is sealed, air access in the device 10 being only through a closeable valve 32.

This air tight tubular member 11 is typically formed of flexible sheet plastic or vinyl material and the like from an elongated generally rectangular panel folded in half lengthwise and then heat sealed lengthwise along seam 22 and transversely to form the ends 40 and 44. Multiple spaced apart folds 14 and 16 are then heat seal formed transversely across the tubular member 11 by attaching in preferably heat sealed fashion opposite oval-shaped areas 18/30 and 20/28 (typically) of opposing side wall surfaces or areas of the tubular member 11 when deflated and in the flat.

Figure 4:
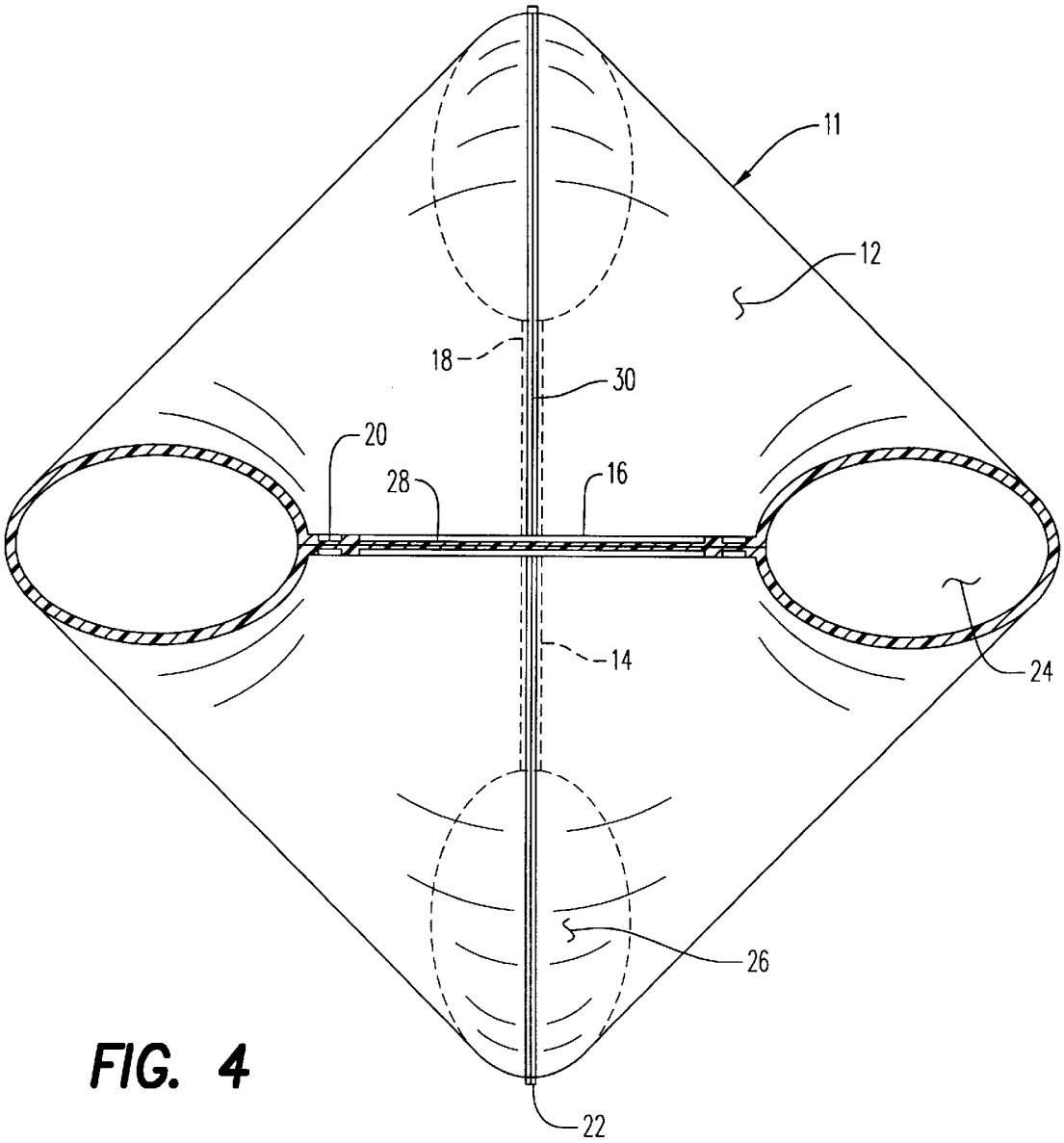
FIG. 4 is a section view in the direction of arrows 4—4 in FIG. 2.

By this arrangement, each of the fold lines 14 and 16 are permanently established and maintained by the attached surfaces/lines 18/30 and 20/28 as best seen in FIG. 4, while end portions 24 and 26 of each of the fold lines remain unattached to provide open passageways to facilitate, uniform inflation and pressurized air balance within the device 10 and within each of the air chambers 12 defined between adjacent folds 14 and 16.

Note importantly that the central portion 14 and 16 defined by the attached surfaces 18 and 20 are oval in shape having a width of about 1:2" and an overall width substantially proportional in a ratio of about 1.2" to the length of each of these attached surfaces 18 and 20. The typical proportionate ratio preferred would be 1:2:4 with respect to the overall width and length of the attached portion 18 and 20 and overall width of the tubular member 11. Alternately, relative size of the width of each tubular member to the unattached expandable outer portions 24 is in the range of 3:1 preferably. The preferred actual dimensions of the overall width and length of the attached surfaces is 1.2" and 2.5", respectively, while the nominal width of the tubular members is about 5.5".

Each successive fold, e.g. 14 followed by 16, is oriented orthogonally to a longitudinal axis of the device 10 when viewed from the side and orthogonally one to another with respect to the same longitudinal axis when viewed from the end of the device 10 as in FIG. 4. Thus, each of the air chambers 12 are defined by folds 14 and 16 at each end thereof which are rotationally oriented orthogonally one to another about the longitudinal axis of the device 10.

Figure 3:
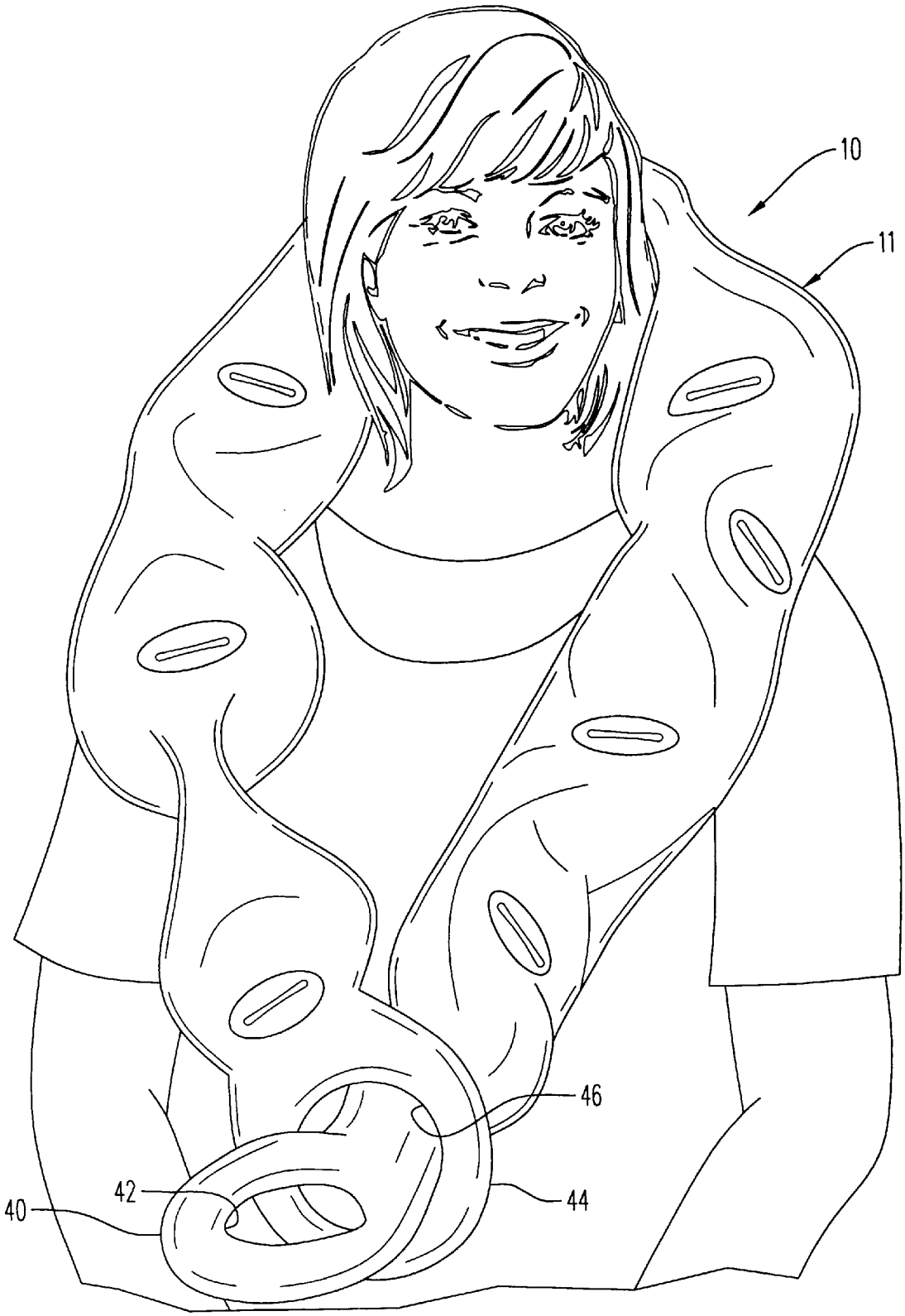
FIG. 3 is a perspective view of the invention of FIG. 1 in use.

By this unique orientation of folds 14 and 16, as best seen in FIG. 3, the device 10, when inflated, is bendably compliant to take various complex arcuate configurations such as around the neck and along the length of the arms without exerting any independent force to maintain this selected configuration. Because each of the folds 14 and 16 are freely bendable in hinge fashion, very little if any force is required to simply reposition and reorient the arcuate configuration of the device along its longitudinal axis A. This resiliently bendable characteristic of the invention eliminates the stressful holding and discomfort of a conventional foam water noodle while in the water such as in support of the neck and shoulders or lower torso of the user when relaxed and floating in water.

Although this embodiment of the invention discloses the fold lines 14 and 16 at an orthogonal or 90° relationship radially with respect to one to another about the longitudinal axis when viewed from its end as in FIG. 4, other angular orientations, e.g. 45°/135° or any other selected acute/obtuse angle relationship may be utilized within the scope of this invention.

Likewise, although it is preferred to have the folds 14 and 16 alternately oriented orthogonally one to another, two or more consecutive folds may also have a similar angular orientation with respect to the longitudinal axis and likewise the angular orientation may be completely random so long as the folds achieve a differing collective angular orientation one to another along the length of the tubular member 11.

This preferred embodiment 10 has end structure at 40 and 44 each having a central aperture 42 and 46 respectively formed therethrough. By this arrangement as best seen in FIG. 3, end 44 is pliably insertable through aperture 42 of end 40 so as to cause the device 10 to take the generally closed shape of an enlarged flexible flotation ring.

Figure 5:
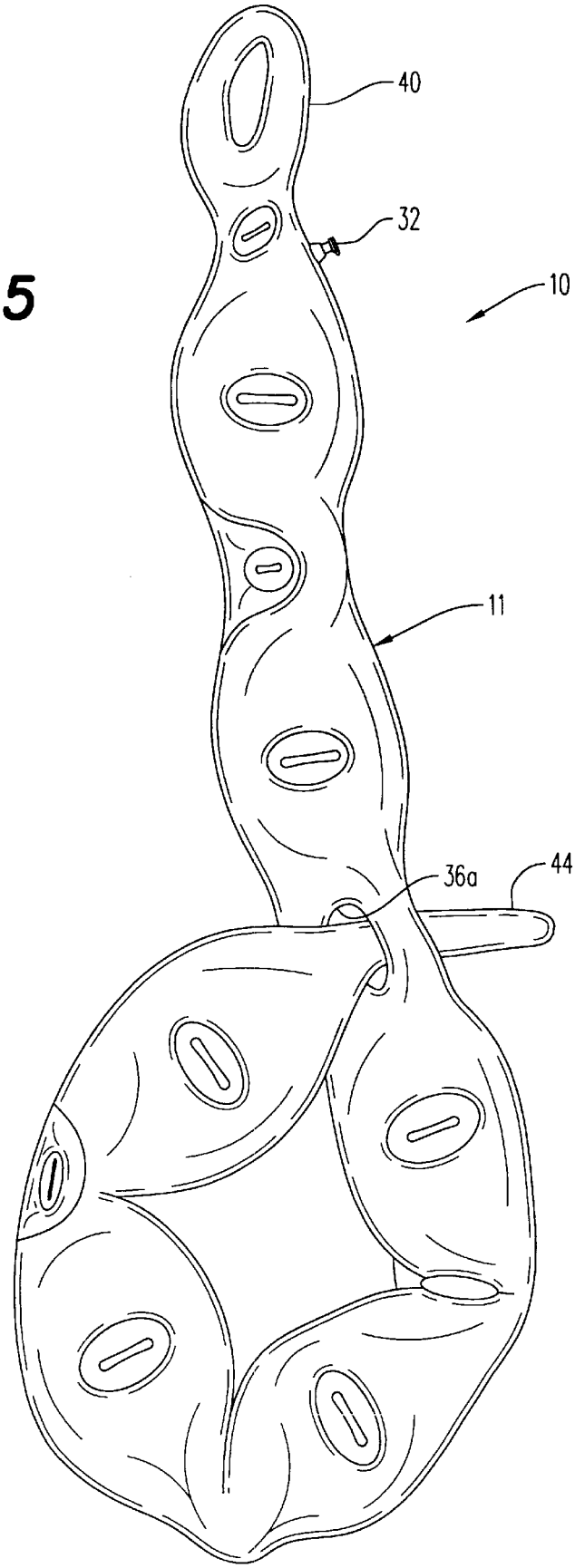
FIG. 5 is a front elevation view of the invention in an alternate configuration of use.
Figure 6:
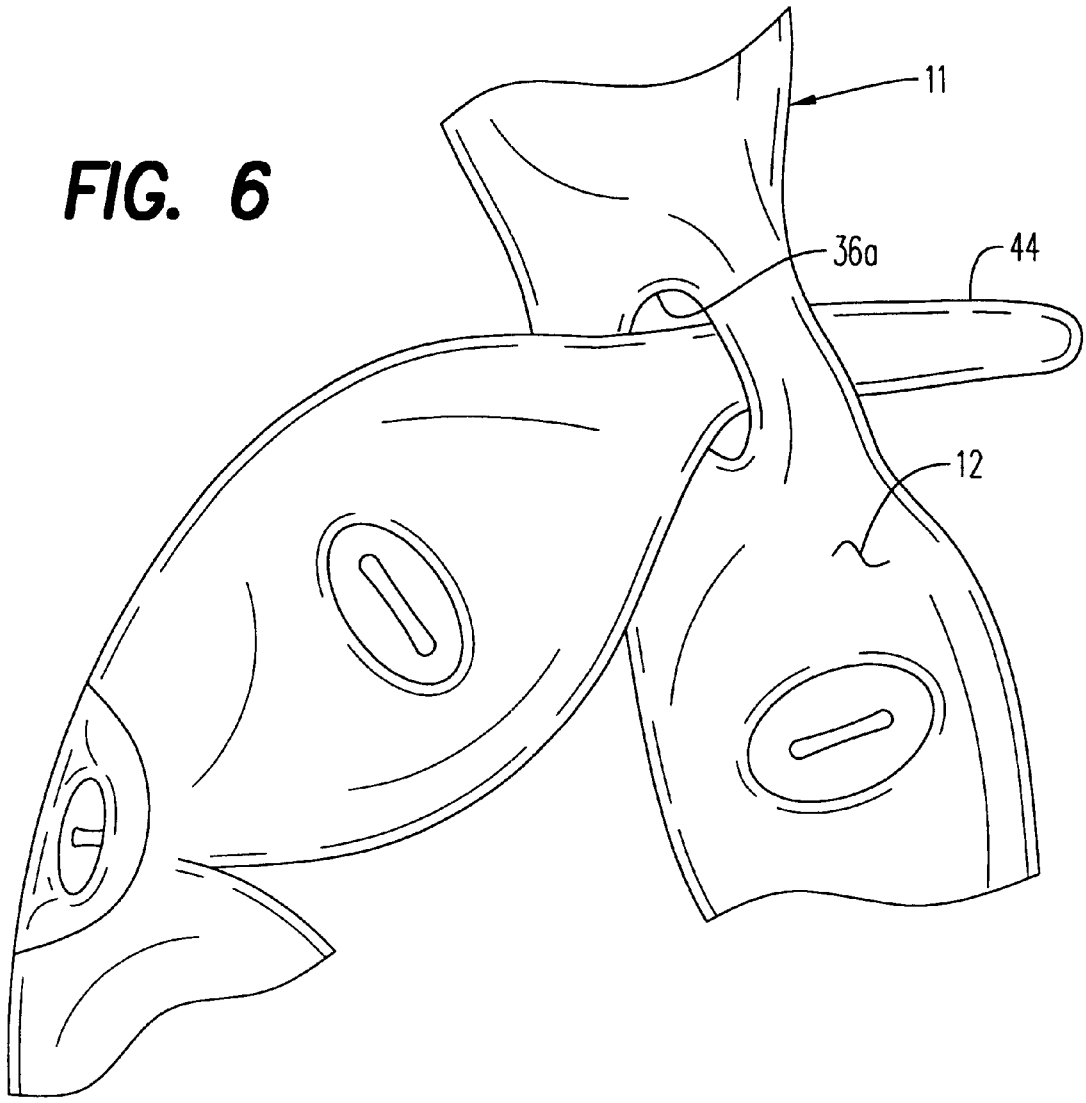
FIG. 6 is an enlarged portion of a portion of FIG. 5 showing one end thereof releasably interconnected with an open attached portion of one fold.
Figure 7:
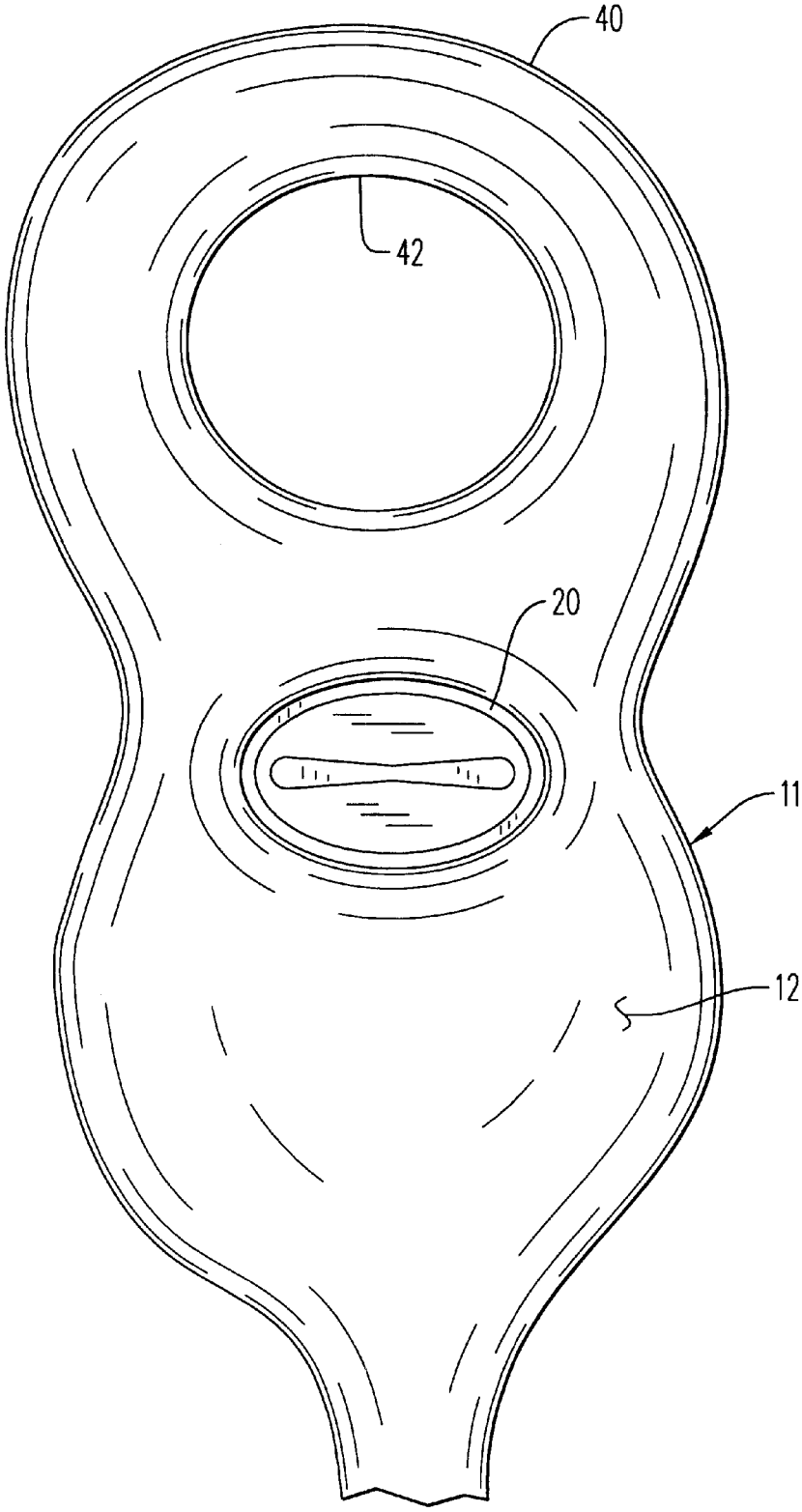
FIG. 7 is an enlarged view of the upper end portion of the invention.

Note as best seen in FIGS. 5 and 6 that one end 44 is also insertable through aperture **36*a* which is formed within one of the attached central portions 18 or 20 as an open configuration. As best seen in FIG. 1, two such openings 36*a* and 36*b* are preferred which afford alternate sizing of the body encircling or grasping ring which is formed at one end portion of the device 10**.

Figure 2:
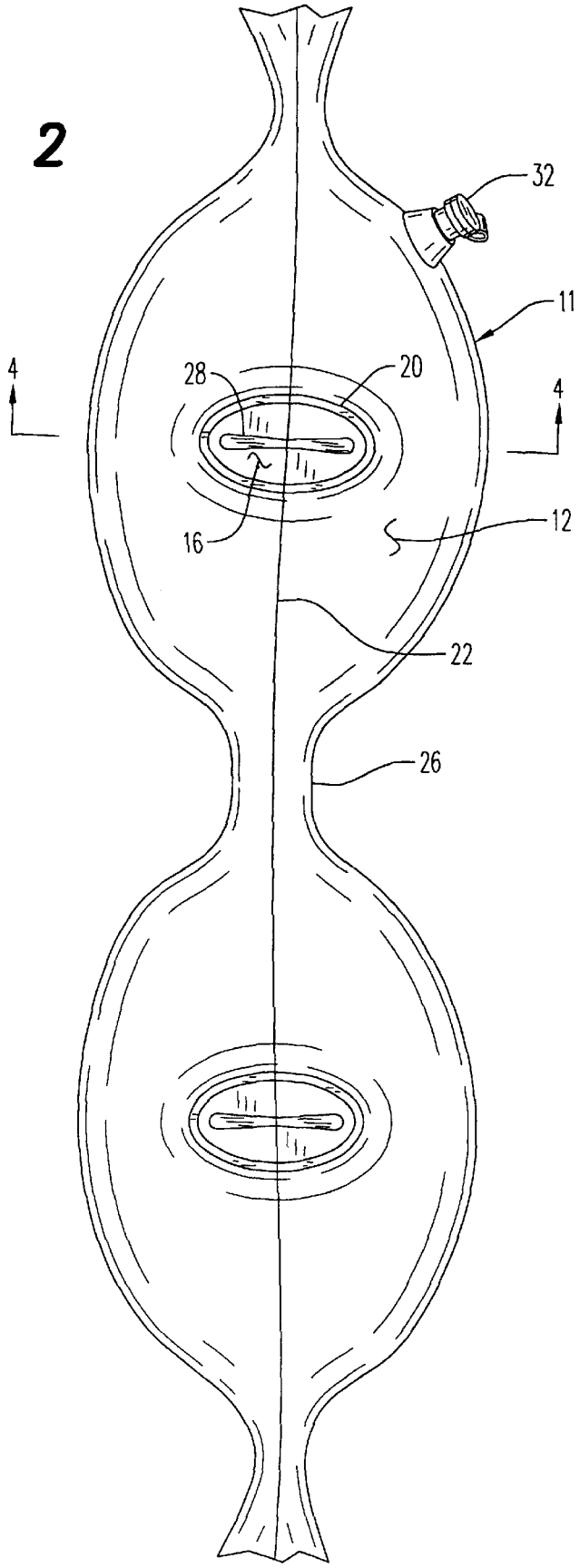
FIG. 2 is an enlarged center portion of FIG. 1.
Figure 8:
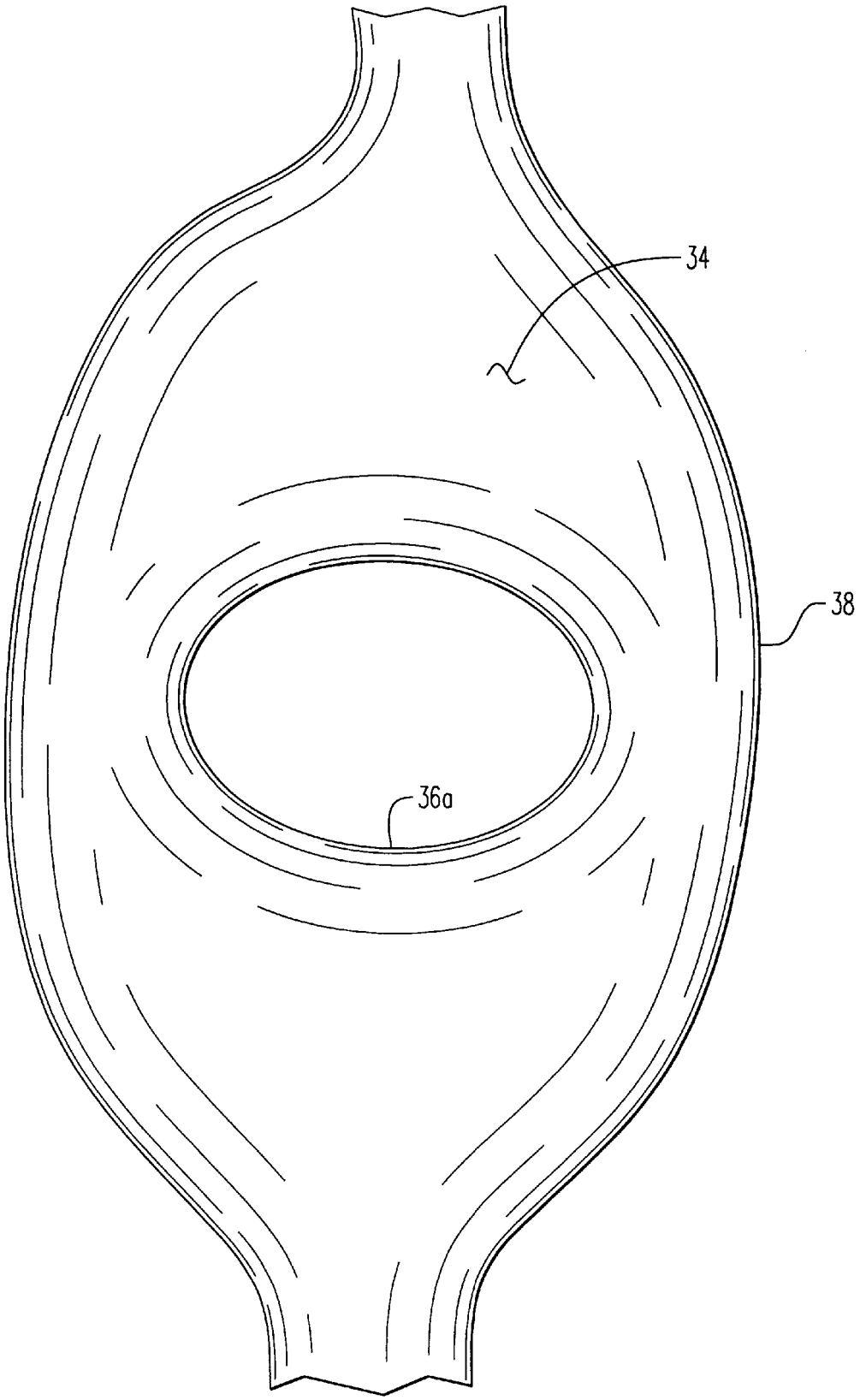
FIG. 8 is an enlarged view of an open central portion of the invention.

Note particularly in FIG. 8 that each of the openings **36*a* and 36*b* are sized approximately the same as the periphery of the oval attached surface 18 or 20 shown and described in the other figures. By this sizing arrangement, the unattached outer portions 38 will allow air passage therethrough and will also expand transversely in side elevation view as best seen in FIG. 2**.

To reiterate, my previous invention in U.S. Pat. No. 6,106,349 disclosed folds which were formed as a line segment with very little if any practical width thereto. By that previous structure, each fold acted almost as a free pivoting hinge with very little resiliency to the fold. Contrarily, the present invention, by providing a central attached portions 18 and 20 having a substantial transverse length and a longitudinal width which are somewhat similar in proportion preferably in the ratio of about 2:1, provides not only an inflatable end portion of each hinge at 24, 26 or 38, but also adds more pliant resistant to bending so that the overall contour of the device in use is more gradual, yet under more flexing force, the folds will bend to their limits as best seen in FIGS. 5 and 6.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An elongated inflatable flotation device which is bendable when inflated, comprising:

an elongated tubular member having a sealed side wall and sealed at each end thereof to form a sealed inflation air chamber;

spaced apart bendable folds each extending across said tubular member and having a central attached portion and unattached end portions, each said attached portion formed by attachment of opposite surfaces of said side wall thereby allowing air within said tubular member to freely flow through each end portion of each said fold to balance air pressure within said tubular member during inflation, deflation and bending thereof;

each particular said fold angularly oriented from each said fold adjacent thereto when viewed along a longitudinal axis of said tubular member thereby allowing said flotation device to be bent in more than one direction radially about said longitudinal axis;

each said central attached portion having a length along a longitudinal axis of said tubular member such that said unattached end portions sufficiently inflate to resiliently resist bending and to stiffen said device while still allowing useful flexing of the entire said device.

2. An inflatable flotation device as set forth in claim 1, wherein:

each said end of said tubular member includes a central aperture formed transversely therethrough and is sized to be pliably fitted through and be retained in the opposite said central aperture whereby said flotation device becomes somewhat ring-shaped.

3. An inflatable flotation device as set forth in claim 2, wherein:

at least one of said central attached portions is open to pliably receive and retain one said end of said tubular member.

4. An inflatable flotation device as set forth in claim 2, wherein:

each said central attached portion is somewhat oval-shaped and having a width-to-length ratio with respect to a width of said tubular member in a range of about 1 to 2 to 4, respectively.

5. An inflatable flotation device as set forth in claim 2, wherein:

each said unattached and portion has a length with respect to a width of said tubular member in a range of at least about 1 to 3.

6. An elongated inflatable flotation device which is bendable when inflated, comprising:

an elongated tubular member having a sealed side wall and sealed at each end thereof to form a sealed inflation air chamber;

spaced apart bendable folds each extending across said tubular member and having a central attached portion and unattached end portions, each said attached portion formed by attachment of opposite surfaces of said side wall thereby allowing air within said tubular member to freely flow through and expanding each end portion of each said fold to balance air pressure within said tubular member during inflation, deflation and bending thereof;

each particular said fold orthogonally oriented from each said fold adjacent thereto when viewed along a longitudinal axis of said tubular member thereby allowing said flotation device to be bent in more than one direction about said longitudinal axis;

at least one of said central attached portions is open to pliably receive and retain one said end of said tubular member.

7. An elongated inflatable flotation device which is bendable when inflated, comprising:

an elongated tubular member sealed at each end thereof to form a sealed inflation air chamber;

spaced apart bendable folds each extending across said tubular member and having a central attached portion and unattached end portions, each said attached portion formed by attachment of opposite surfaces of a side wall of said tubular member thereby allowing air within said tubular member to freely flow through and expanding each end portion of each said fold to balance air pressure within said tubular member during inflation, deflation and bending thereof;

each particular said fold extending across a longitudinal axis of said tubular member and having a varying radial orientation thereby allowing said flotation device, when inflated, to be bendable about one or more said folds and, thereby, in multiple directions about said longitudinal axis;

each said central attached portion having a length along the longitudinal axis of said tubular member such that said unattached end portions sufficiently inflate to resiliently resist bending and to stiffen said device while still allowing useful flexing of the entire said device.

8. An inflatable flotation device as set forth in claim 7, wherein:

each said end of said tubular member includes a central aperture formed transversely therethrough and is sized to be pliably fitted through and be retained in the opposite said central aperture whereby said flotation device becomes somewhat ring-shaped.

9. An inflatable flotation device as set forth in claim 8, wherein:

at least one of said central attached portions is open to pliably receive and retain one said end of said tubular member.

10. An inflatable flotation device as set forth in claim 8, wherein:

each said central attached portion is somewhat oval-shaped and having a width-to-length ratio with respect to a width of said tubular member in a range of about 1 to 2 to 4, respectively.

11. An inflatable flotation device as set forth in claim 8, wherein:

each said unattached and portion has a length with respect to a width of said tubular member in a range of at least about 1 to 3.

* * * * *